United States Patent [19]

Zilinsky

[11] 4,456,441

[45] Jun. 26, 1984

[54] ROTARY MACHINE

[76] Inventor: Aharon Zilinsky, 26 Tel Hai St., Ramath Gan, Israel

[21] Appl. No.: 351,604

[22] Filed: Feb. 23, 1982

[51] Int. Cl.[3] ..... F01C 1/00; F01C 17/02; F01C 19/00

[52] U.S. Cl. ..... 418/147; 418/175; 418/177; 418/186; 418/255

[58] Field of Search ..... 418/175, 177, 255, 147, 418/186, 227

[56] References Cited

U.S. PATENT DOCUMENTS

| | | | |
|---|---|---|---|
| 385,805 | 7/1888 | Gregersen et al. | 418/175 |
| 640,746 | 1/1900 | Conner | 418/255 |
| 803,599 | 11/1905 | Jungersen et al. | 418/255 |
| 883,605 | 3/1908 | Abbott | 418/255 |
| 1,977,780 | 10/1934 | Stageberg | 418/255 |
| 2,117,573 | 5/1938 | Rawls | 418/255 |
| 2,827,025 | 3/1958 | Puim | 418/255 |
| 3,251,308 | 5/1966 | Dugan | 418/175 |
| 3,642,390 | 2/1972 | Ostberg | 418/175 |

*Primary Examiner*—John J. Vrablik
*Attorney, Agent, or Firm*—Toren, McGeady and Stanger

[57] ABSTRACT

A rotary engine, either prime mover—or pump or compressor—comprises as its basic element a circular casing in which is journalled rotatably a hollow, cylindrical body, the interior wall face of which ascribes a space delimited by recesses alternating with portions extending towards the center of the space, each recessed portion being diametrically opposite an inwardly extending portion, a solid cylindrical body being positioned within the space, a throughgoing bore extending across the axis of the solid cylindrical body in which bore a piston like member can perform a reciprocal movement. In the case of an internal combustion engine explosion and expansion occur in the space within the hollow cylindrical body and cause it to rotate: rotative movement is derived from a shaft of the body. A drive could be applied to the shaft so that a fluid could be compressed in the space. In use as a pump the fluid to be conveyed is sucked into the working space and expelled therefrom.

4 Claims, 9 Drawing Figures

ROTARY MACHINE

BACKGROUND OF THE INVENTION

The present invention relates to a rotary machine which—with appropriate fittings and adaptation of the basic design—may constitute a prime mover of internal combustion type, a pump or a compressor.

The basic element of the new machine comprises a circular casing in which is journalled rotatably a hollow, cylindrical body, the interior wall face of which ascribes a space delimited by recesses alternating with portions extending towards the centre of the said space, each recessed portion being diametrically opposite an inwardly extending portion, a solid cylindrical body being positioned within the said space, a throughgoing bore extending across the axis of the said solid cylindrical body in which bore a piston like member can perform a reciprocal movement.

The space within the said hollow cylindrical body will be referred to hereinafter as "working space", because in use as an internal combustion engine explosion and expansion will take place in that space and will cause the hollow cylindrical body to rotate, so that rotative movement can be derived from its shaft (by which it is journalled within the circular casing). In the same way the machine may be driven by applying a drive to the said shaft with the consequence that a fluid—be it air, or another gas—is compressed in the working space. In use as a pump the fluid to be conveyed is sucked into the working space and expelled therefrom. Those skilled in the art will understand that a basic machine as the one referred to above can serve the three purposes, once it has been adapted by conventional means to the desired purpose.

The basic element mentioned above functions in the following manner. The said recesses which are delimited in vertical direction by the wall face of the hollow cylindrical body and one end face of the piston like member plus portions of the said cylindrical body constitute chambers in which operative functions of the machine take place, be it explosion followed by expansion, be it insucking followed by compression or pumping action. These chambers contract and expand alternatingly: the piston like member is caused to perform an axial movement—to one direction or the other—whenever an end face of the piston like member passes across an inwardly extending portion of the inner wall face of the hollow cylindrical body. Since—as has been stated—each recess in the wall of the hollow body is opposite a portion extending towards the centre of the hollow body, the reciprocal movement of the piston like body becomes possible. Assuming now that, say, a combustible mixture is injected into a working space (as defined above) and is ignited by means of a plug as conventionally used in internal combustion engines, explosion will occur, the mixture being combusted, causes the hollow cylindrical body to rotate. Since there are a number of working spaces, ignition and explosion in one working space is followed by the same in a subsequent working space, the consequence being that the hollow cylindrical body rotates uniformly within the casing. Obviously this rotating movement can be employed in a conventional way.

Those skilled in the art will easily understand that in a like manner the new machine can work as a pump, or a compressor, once it has been appropriately adapted for such purpose.

SHORT DESCRIPTION OF DRAWINGS

The above description is that of the basic elements of the new machine. In the following a machine or engine built on this principle, but including the parts which render it operative will be described with reference to the accompanying drawings.

In the drawings FIG. 1 is an axial section of the new rotary machine, while FIG. 2 is a horizontal section on line II—II of FIG. 1.

FIG. 9 illustrates a somewhat varied form of the new rotary machine.

DESCRIPTION OF PREFERRED EMBODIMENT

In casing 1 is journalled a shaft 2 integral with the cylindrical body 2'. (In practice this part of the machine may be composed of several elements which are fixedly connected with one another, but for all practical purposes may be regarded as one integral part).

Figure 2:
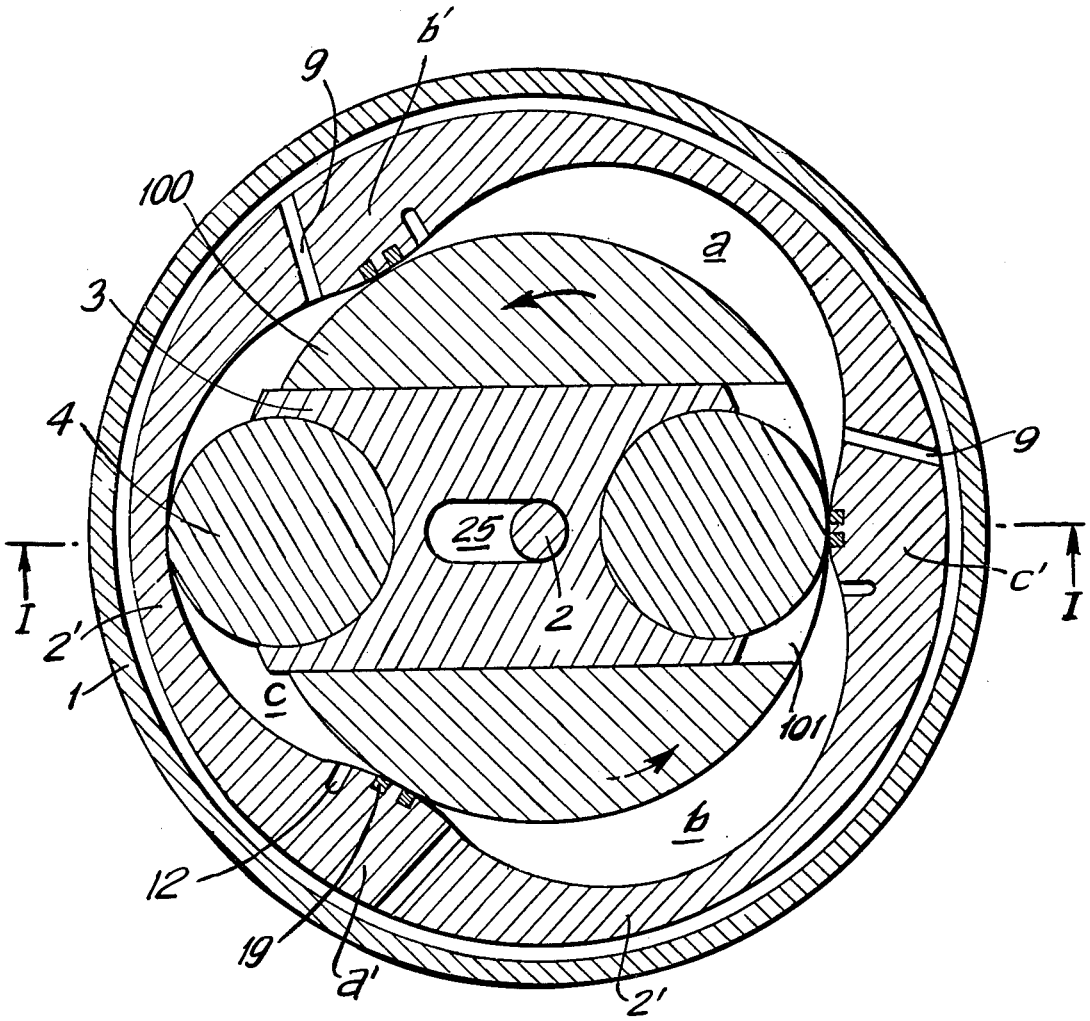

As shown in FIG. 2 the inner wall of body 2' has three recesses which may be likened—when seen in section across the axis 2—as a "trifoil design". As indicated above, diametrically opposite each recess is positioned a rib. The recesses which are crescent shaped are designated by letters a,b,c, while the respective opposite ribs are marked a',b',c'. At the peak of each rib are provided packings 19 establishing the required tightness between the contacting faces of ribs a',b',c' and a body which moves relative to them (and to which reference will be had).

Figure 1:
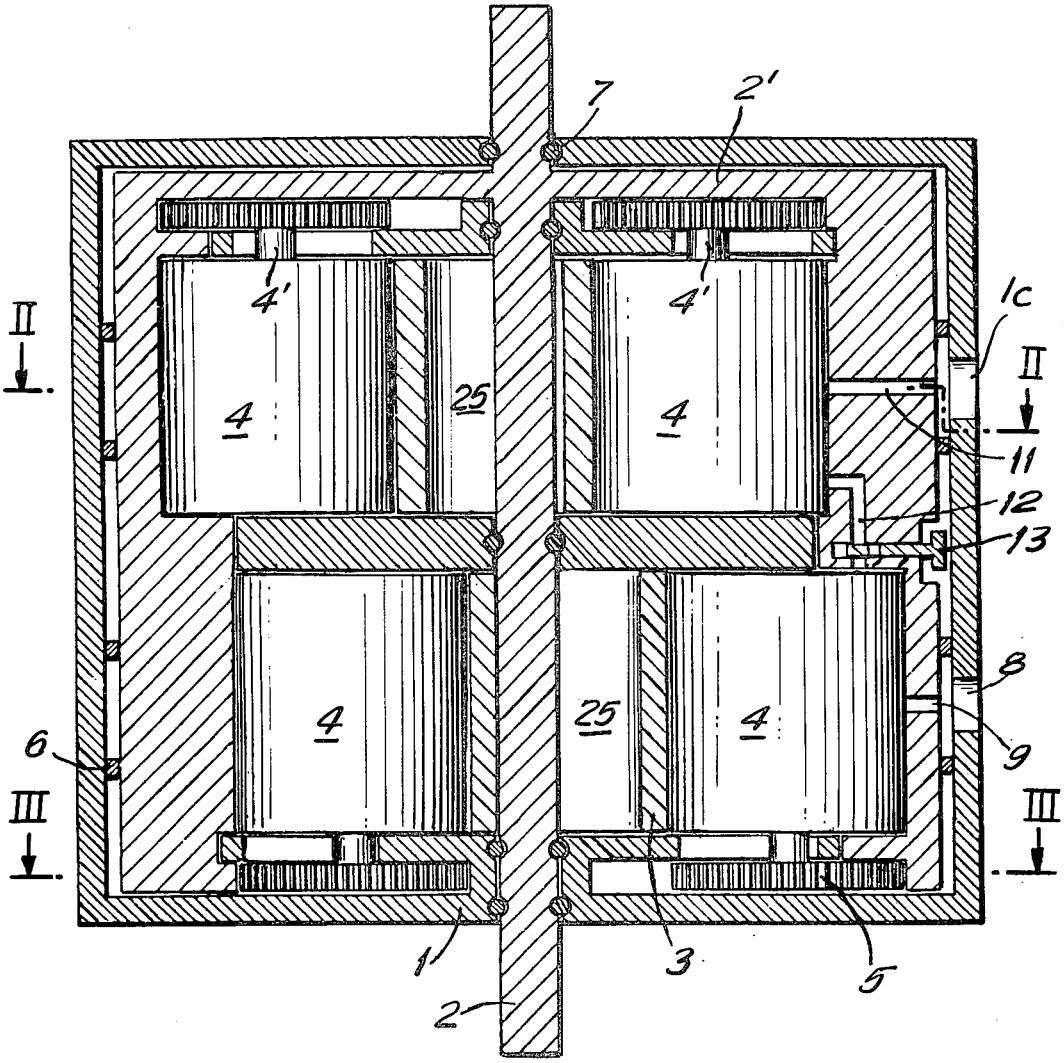

As can be seen in FIGS. 1 and 2—in the cylindrical body 2' is positioned—at two levels, and one at each level—a solid cylindrical body 100 which is traversed by a bore 101 extending normal to shaft 2. In the bore 101 is slidingly held a body 3. Through that body 3 extends a slot 25 through which the shaft 2 passes. In the two end faces of body 3 are held—one in each face—piston like bodies 4.

Figure 3:
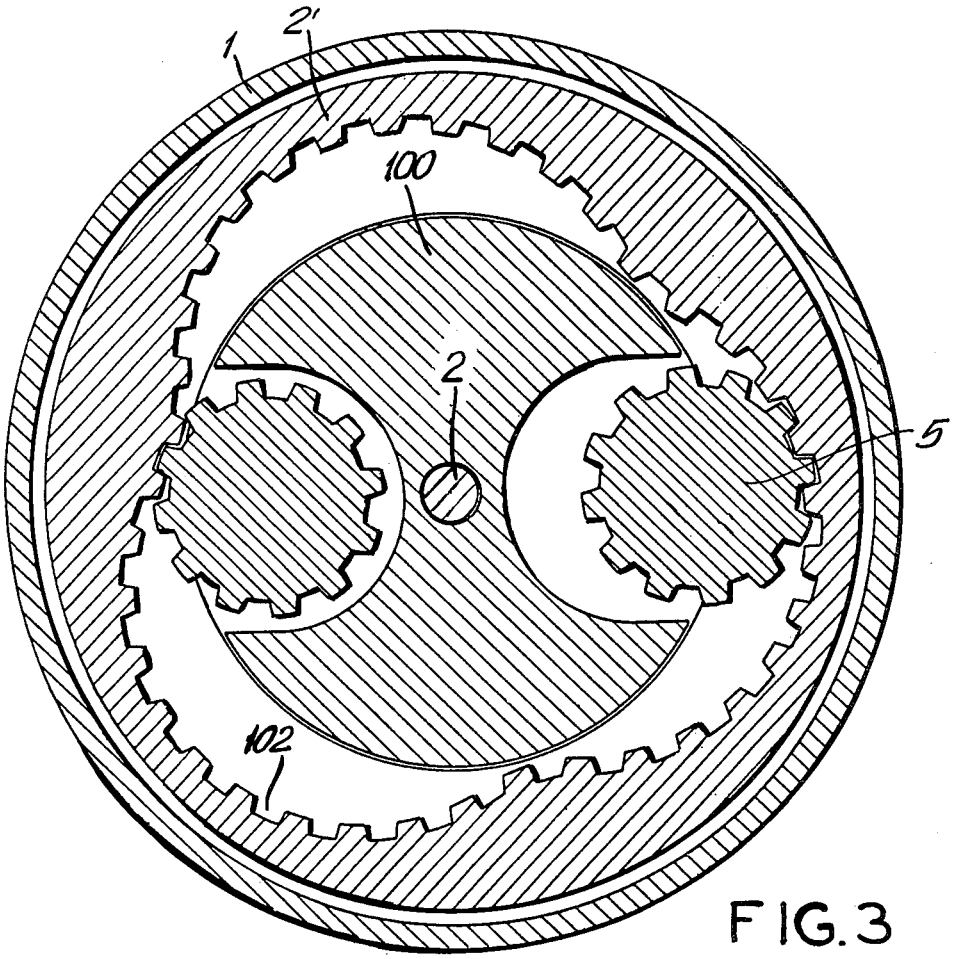
FIG. 3 shows a section on line III—III of FIG. 1.

Each of these bodies 4 has extending from one of its circular end faces a short shaft 4' on which is keyed a gear wheel 5. These wheels mesh with an internally toothed gear rim 102 which is integral with body 2' (see FIG. 3). In accordance with the outline of the interior wall face of body 2', the gear rim 102 follows a trifoil like line.

As will be noted by looking at FIG. 1 and FIG. 2, the two bodies 3, positioned one above the other are also set off against one another in their longitudinal directions.

As has been mentioned above, the interior space defined by body 2' is the working space and (in the case of being designed as an internal combustion engine) compression, explosion and expansion of the combustive mixture take place in the crescent shape recesses a,b,c. Accordingly, there are provided inlet ports 9 into each recess and outlet ports 11 from each recess. There are further provided passages 12 from the working space at one level to that of the second level. These passages 12 are controlled by valves 13. At 14 an ignition plug can be located (or fuel injector).

Figure 4:
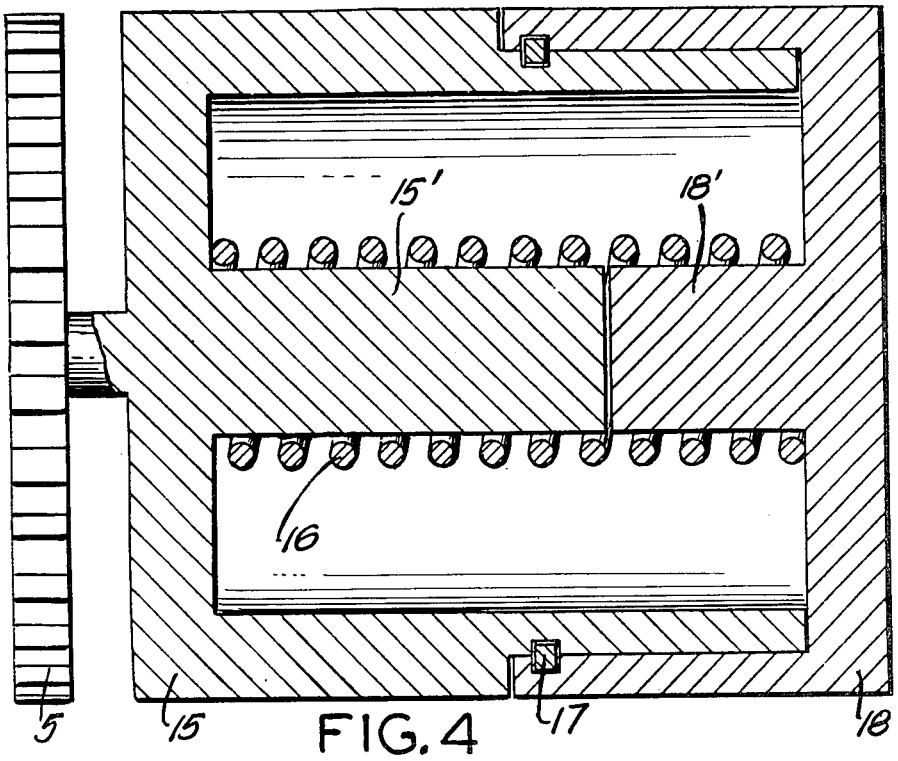
FIG. 4 is an axial section through the piston like body mentioned above.
Figure 5:
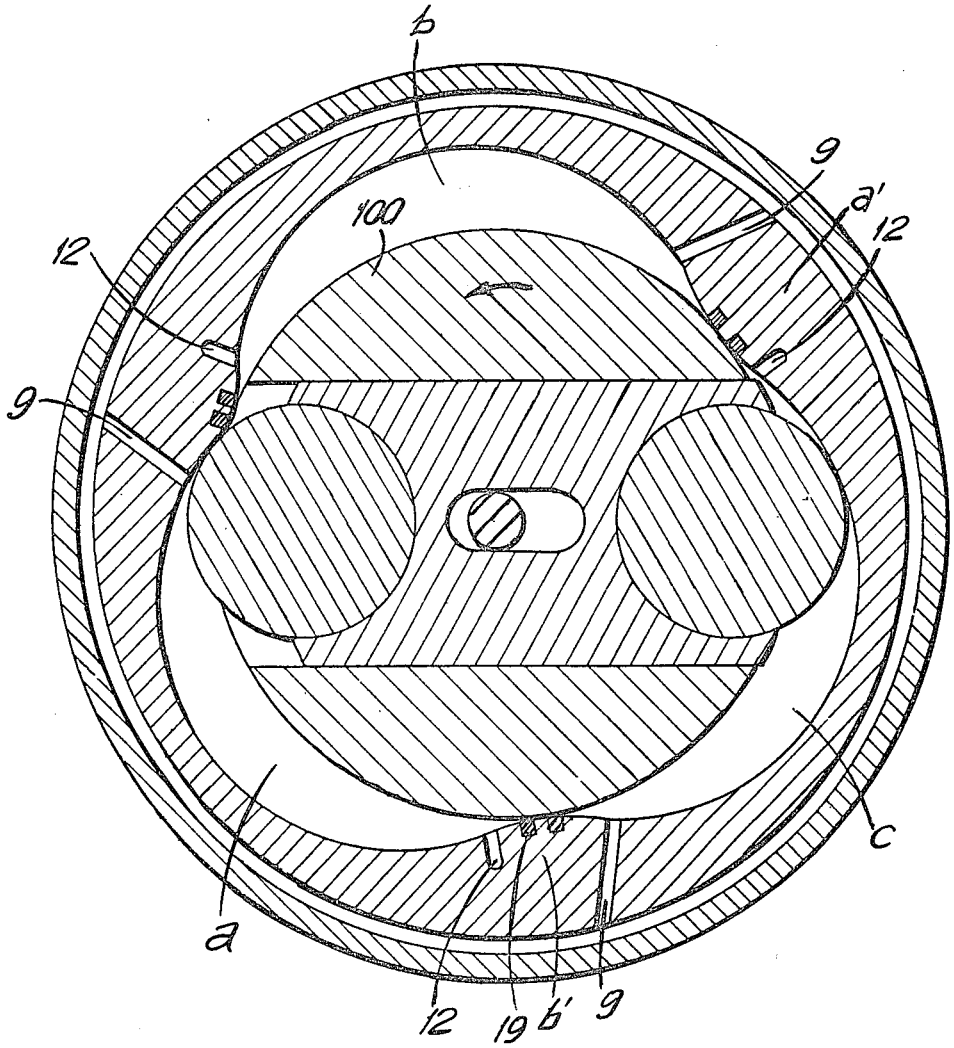
FIGS. 5-6-7-8 are horizontal sections, similar to FIG. 2, at different stages of operation, the sections being at different levels.
Figure 6:
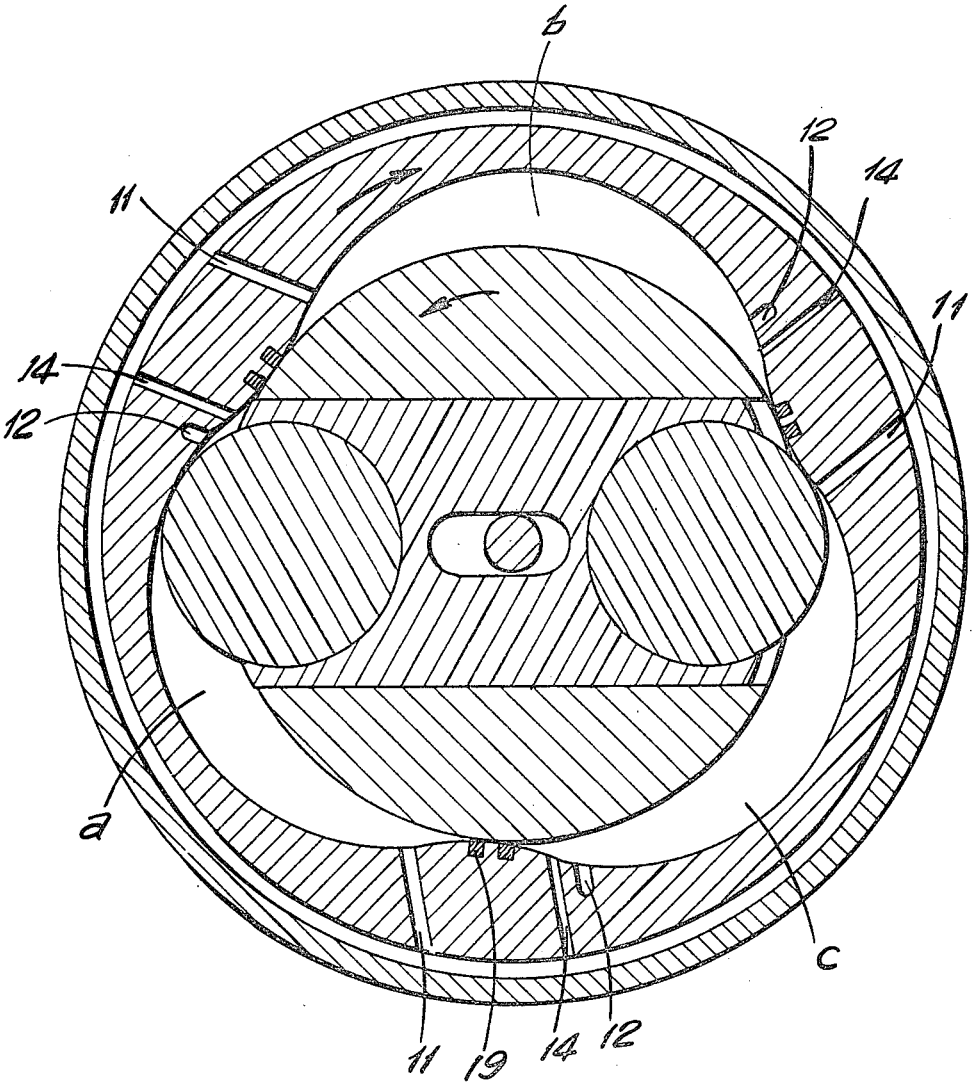
Figure 7:
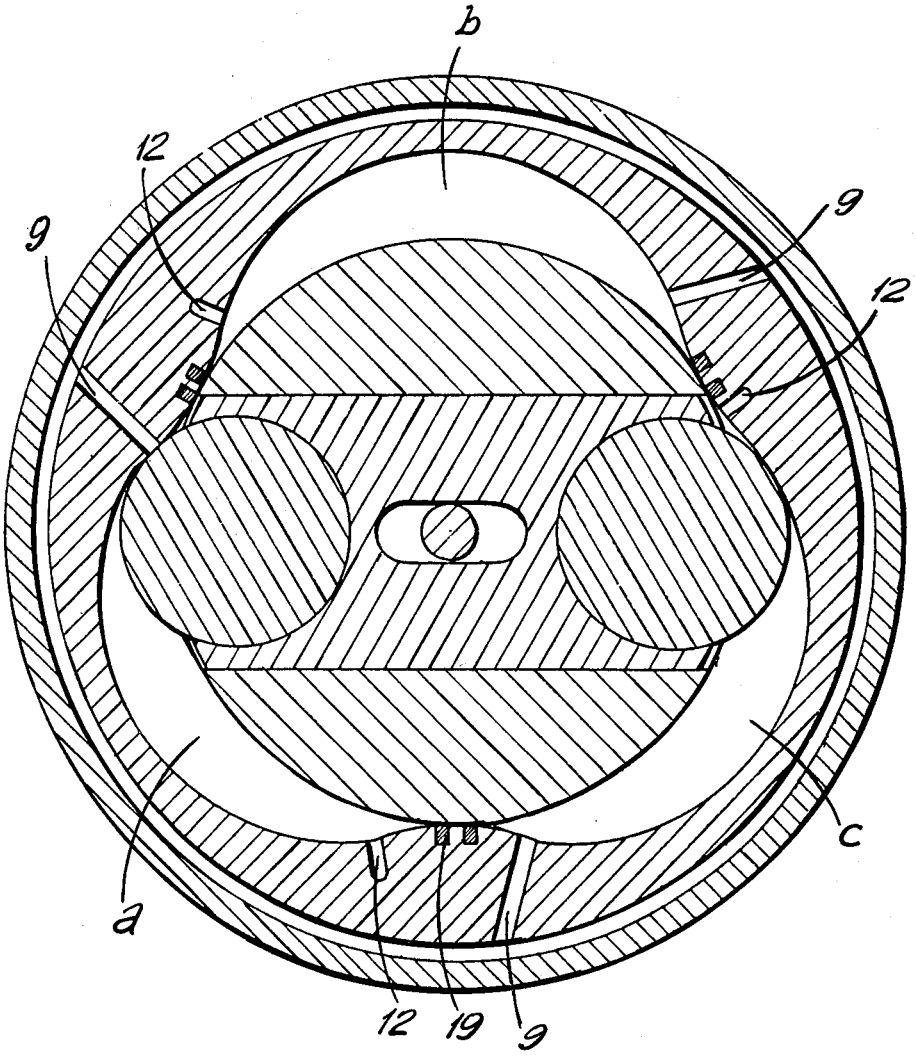
Figure 8:
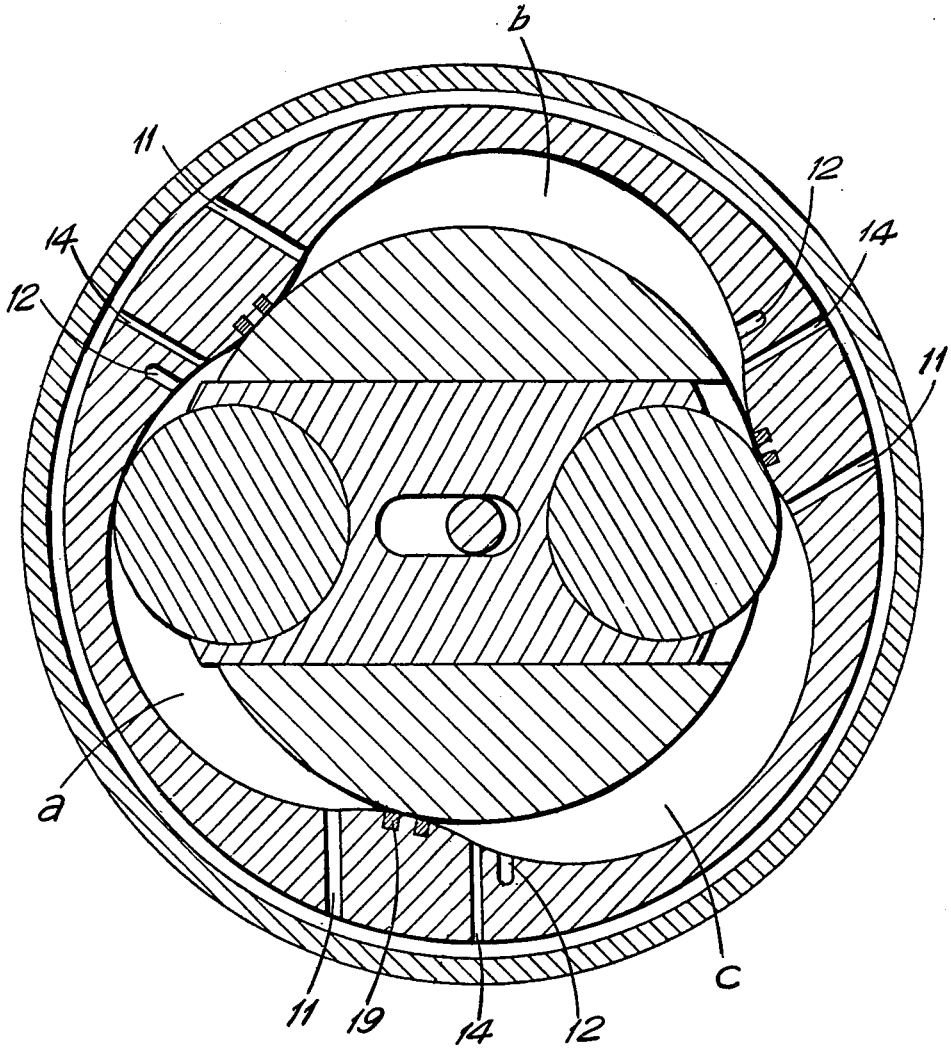

FIG. 4 illustrates a preferred construction of the body 4. It is composed of two interfitting cup shaped parts 15 and 18 in each of which there is provided—at the inner "bottom" of the cup a boss 15', 18' respectively. The two bosses fit registeringly onto one another. Around the colinear bosses 15', 18' extends a helical spring 16 urging the two apart and thus ensuring their being firmly and tightly being held. A packing ring 17 ensures tightness between parts 15, 18.

The new machine functions as will be described in connection with FIGS. 5–8. Assuming that by means of a starter of conventional type the machine is started, i.e. the cylinder 2' is rotated—say, anticlockwise and at the same time an air fuel mix is injected—say into the crescent shaped chamber b through the inlet 9, the fuel mix will first be compressed in b, and will explode in due course. The compression is due to the anticlockwise movement of 2' and thus diminishing the volume of chamber b. This movement is possible due to the fact that body 3 can yield moving to the right of FIG. 5. When the rib designated b' is met by the left hand piston like body, the body 3 is urged into right hand direction. Now, if with proper timing fuel is injected into chamber a compression is attained, followed by explosion and expansion, urging the cylindrical body 2 into and maintaining it in rotation. The process is repeated in chamber c and so on.

However, as has been stated already, there may be provided bodies 3 superposed onto one another, as actually seen in FIG. 1. Preferably therefore the stages of compression, explosion and expansion may be made to occur in different chambers of the superposed sets. Thus fuel might be injected into one of the chambers, say in the right hand, lower set of FIG. 1, being partly compressed there and carried via duct 12 (see FIG. 1 and FIGS. 5–8) into a chamber above, where compression is completed and explosion occurs. The valve 13 prevents combustion gases to flow back into a lower chamber.

The outlet ports through which spent gases escape are shown in FIG. 1 at 8.

Turning now to the variant of FIG. 9: Here again is the casing 1, the shaft 2 and the body 2' and the body 100. It is assumed that in the construction of FIG. 9 the body 100 rotates, while body 2 is stationary.

In the three ribs a',b',c' there are provided cylindrical chambers 110, 111, 112 respectively. Chamber 110 is connected with the space of recess b via a passage 113, the chamber 11 with recess c via a passage 114 and the chamber 112 with recess a via a passage 115. Further, there are passages 116 connecting recess a with chamber 110, passage 117 connecting chamber 111 with recess b and passage 118 leading from recess c into chamber 112.

This variant functions in principle as the constructions already described, with the following change.

Assuming as has been stated that member 100 revolves clockwise, compression is being built up in that part of recess b which in FIG. 9 is uppermost and spreads via passage 117 into chamber 111. If now fuel is injected in that chamber, explosion would occur once pressure is high enough, i.e. the engine would operate on the Diesel principle. However, a sparking plug could be set in the wall of body 2 and the engine could operate as an Otto motor. Following explosion, the expanding gases travel via passage 114 into recess e where the performance repeats, and again repeats in recess a and chamber 110.

What is claimed is:

1. Rotary machine, such as an internal combustion engine, a compressor or a pump, comprising a circular casing having an axis, a hollow cylindrical body coaxially arranged within and having a shaft rotatably journalled in said circular casing, said hollow cylindrical body has an internal wall face extending in the axial direction of and circumferentially around the axis of said casing and laterally describing a working space limited at said wall face by alternating outwardly extending recesses and radially inwardly directed ribs spacing said recesses apart in the circumferential direction, each said recess being diametrically opposite one of said radially inwardly directed ribs, at least one solid cylindrical body having an axis extending parallel with the axis of said casing and said hollow cylindrical body and positioned within said working space, a throughgoing bore extending across the axis of said solid cylindrical body, a piston-like member mounted in said throughgoing bore for performing a sliding reciprocal movement therein in the direction transverse to the axis of said shaft of said hollow cylindrical body, said piston-like member having a pair of opposite end faces, a piston-like body mounted in each of said end faces and arranged to contact said internal wall face, each said piston-like body has a shaft extending parallel to and spaced radially outwardly from the axis of said solid cylindrical body, a gear wheel secured to each shaft of said piston-like bodies, a gear rim formed in said internal wall face and following the contour of said recesses and said ribs, and said gear wheels disposed in meshed engagement with said gear rim.

2. Rotary machine as claimed in claim 1, characterised thereby that in said working space there are provided three recesses alternating with three said ribs and each said recess is opposite one of said ribs.

3. Rotary machine as claimed in claim 1 or 2, characterised thereby that each said recess forms a crescent shaped chamber in the direction transversely of the axis of said casing.

4. Rotary machine as claimed in claim 1, characterised thereby that the said piston like member which extends across the axis of said solid cylindrical body has an elongated aperture therein elongated transversely of the axis of said hollow cylindrical body and said shaft by which said hollow cylindrical body is journalled in said casing and extends through said elongated aperture.

* * * * *